US009525946B2

(12) United States Patent
Bank

(10) Patent No.: US 9,525,946 B2
(45) Date of Patent: Dec. 20, 2016

(54) ACOUSTIC DEVICE

(75) Inventor: Graham Bank, Woodbridge (GB)

(73) Assignee: Flat Audio Technologies LLC, Woodinville, WA (US)

( * ) Notice: Subject to any disclaimer, the term of this patent is extended or adjusted under 35 U.S.C. 154(b) by 504 days.

(21) Appl. No.: 12/996,080

(22) PCT Filed: Jun. 16, 2009

(86) PCT No.: PCT/GB2009/050681

§ 371 (c)(1),
(2), (4) Date: Feb. 18, 2011

(87) PCT Pub. No.: WO2009/153591

PCT Pub. Date: Dec. 23, 2009

(65) Prior Publication Data

US 2011/0142277 A1 Jun. 16, 2011

(51) Int. Cl.

| | |
|---|---|
| ***H04R 1/00*** | (2006.01) |
| ***H04R 9/04*** | (2006.01) |
| ***H04R 1/24*** | (2006.01) |
| *H04R 7/04* | (2006.01) |

(52) U.S. Cl.

CPC ..... *H04R 9/045* (2013.01); *H04R 1/24* (2013.01); *H04R 7/045* (2013.01); *H04R 2440/05* (2013.01)

(58) Field of Classification Search

CPC ..... H04R 1/00
USPC ..... 381/396, 398; 310/348
See application file for complete search history.

(56) References Cited

U.S. PATENT DOCUMENTS

| | | | | |
|---|---|---|---|---|
| 5,245,669 | A * | 9/1993 | Bittencourt | 381/184 |
| 6,675,931 | B2 * | 1/2004 | Sahyoun | 181/157 |
| 7,454,025 | B2 * | 11/2008 | Saiki | 381/161 |
| 7,653,209 | B2 * | 1/2010 | Abe et al. | 381/414 |
| 2005/0168111 | A1 * | 8/2005 | Bank et al. | 310/348 |

FOREIGN PATENT DOCUMENTS

| | | |
|---|---|---|
| JP | 57-068993 | 4/1982 |
| JP | 57-083995 | 5/1982 |

(Continued)

OTHER PUBLICATIONS

PCT International Preliminary Report on Patentability for PCT/GB2009/050681, Issued Dec. 18, 2010, 7 pages, The International Bureau of WIPO, Geneva, Switzerland.

(Continued)

*Primary Examiner* — Duc Nguyen
*Assistant Examiner* — Phan Le

(57) ABSTRACT

An acoustic device intended to operate pistonically and in bending comprising a panel-form acoustic radiator, a magnetic drive system including a voice coil on a tubular bobbin, the bobbin being directly coupled to the radiator to drive the radiator directly; and a coupling device connected to the bobbin, and to the radiator at a position at or near to the first nodal line of bending resonance of the radiator. A method of improving the on-axis response of a loudspeaker having a panel-form radiator and intended to operate both pistonically and in bending, comprising driving the radiator by a directly connected tubular bobbin, and substantially suppressing the lowest natural frequency of the radiator by providing a coupler connected from the bobbin to the radiator at or near to its first nodal line.

15 Claims, 7 Drawing Sheets

(56) References Cited

FOREIGN PATENT DOCUMENTS

| | | | |
|---|---|---|---|
| JP | 58-015399 | A | 1/1983 |
| JP | 58-044895 | | 3/1983 |
| JP | 58-130698 | | 8/1983 |
| JP | 58-137398 | A | 8/1983 |
| JP | 58-197998 | A | 11/1983 |
| JP | 60-062798 | A | 4/1985 |
| JP | 61-113399 | | 5/1986 |
| JP | 61-139199 | A | 6/1986 |
| JP | 62-237900 | A | 10/1987 |
| JP | 62-269500 | A | 11/1987 |
| JP | 2002-528019 | A | 8/2002 |
| JP | 2007-533230 | A | 11/2007 |
| WO | 0022877 | A | 4/2000 |
| WO | 2005/101899 | | 10/2005 |
| WO | 2005101899 | A | 10/2005 |

OTHER PUBLICATIONS

PCT Written Opinion of the International Searching Authority for PCT/GB2009/050681, 6 pages, European Patent Office, Munich, Germany.

* cited by examiner

ACOUSTIC DEVICE

TECHNICAL FIELD

This invention relates to acoustic devices, such as loudspeakers and microphones, and to drive units for such devices. More particularly the invention relates to acoustic devices as aforesaid having panel-form acoustic radiators which work both in bending mode and pistonically, for example as a full-range device operating over a substantial part of the audio spectrum.

BACKGROUND ART

The reduced depth of a generally flat panel-form loudspeaker radiator is clearly advantageous, and there have been many attempts to provide a practical design, but the inherent disadvantage of anomalies in the on-axis frequency response have not been overcome.

It is an object of the invention to mitigate the disadvantages of prior art speakers.

DISCLOSURE OF THE INVENTION

According to the invention an acoustic device comprises a panel-form or planar acoustic radiator; a magnetic drive system including a voice coil on a tubular bobbin, the bobbin being connected to drive the radiator directly; and a coupling device connected to the bobbin, and to the radiator at a position at or near to the first bending nodal line of the radiator.

Planar diaphragm or radiator loudspeaker drivers are preferred as they avoid the potentially resonant acoustic cavity of conventional cone type drivers. A cone diaphragm is, however, relatively rigid for its mass, with a quite wide piston frequency range before the cone breaks up into secondary resonances. When the radiator or diaphragm is formed as a panel the bending rigidity is far lower and means are required to control the bending behaviour in order to extend the frequency range. At low frequencies the panel operates as a piston, but at higher frequencies, where bending behaviour is inevitable, it is advantageous to use a conventionally dimensioned small voice coil and bobbin where the higher frequency range is satisfactorily maintained in response and in directivity. Moderate voice coil sizes are also more economical.

There is a problem with such loudspeaker drivers as a result of anomalies in the frequency response. These anomalies are addressed by the present invention by means of a light weight auxiliary coupler for example in the form of a small cone. This auxiliary coupler is connected to the region of the panel diaphragm between the direct voice coil bobbin connection to the panel and the panel perimeter. The larger diameter of the auxiliary coupler is connected to the panel; the small diameter is connected to the voice coil bobbin.

Thus by way of example a circular panel can be driven simultaneously from the small bobbin diameter of the voice coil but also via the auxiliary coupler cone on a larger diameter of the panel. The additional coupler controls the response anomalies of wider frequency range planar diaphragms.

Where the radiator panel is circular, the coupling device may be a cone connected to the radiator panel at a circle at approximately ⅔ of the panel diameter. The circle may be at ⅔ of the panel diameter +/−20%, preferably +/−10%. The circle may be at 0.68 of the panel diameter.

Alternatively the radiator panel may be rectangular and the coupling device may be connected to the radiator panel along at least two straight lines substantially coincident with the first nodal lines of the panel.

The coupling device may be arranged to decouple from the radiator panel at a frequency just above the frequency which generates the first nodal line.

It is an advantage of a loudspeaker according to the invention that the size of the voice coil can be that normally used in the prior art for that size of panel, but with the on-axis response anomaly mitigated.

The present invention may be applied to balanced mode panel-form radiators of the kind described in International Application WO 2005/101899 of New Transducers Limited. A balanced mode radiator loudspeaker is an acoustic device comprising a radiator diaphragm having an area and having an operating frequency range and the diaphragm being such that it has resonant modes in the operating frequency range, an electromagnetic transducer having a drive part coupled to the diaphragm and adapted to exchange energy with the diaphragm, and at least one mechanical impedance means coupled to or integral with the diaphragm, the positioning and mass of the at least one mechanical impedance means being such that the net transverse modal velocity over the area of the diaphragm tends to zero.

BRIEF DESCRIPTION OF DRAWINGS

The invention is diagrammatically illustrated, by way of example, with reference to the accompanying drawings, in which:—

BEST MODES FOR CARRYING OUT THE INVENTION

Figure 1:
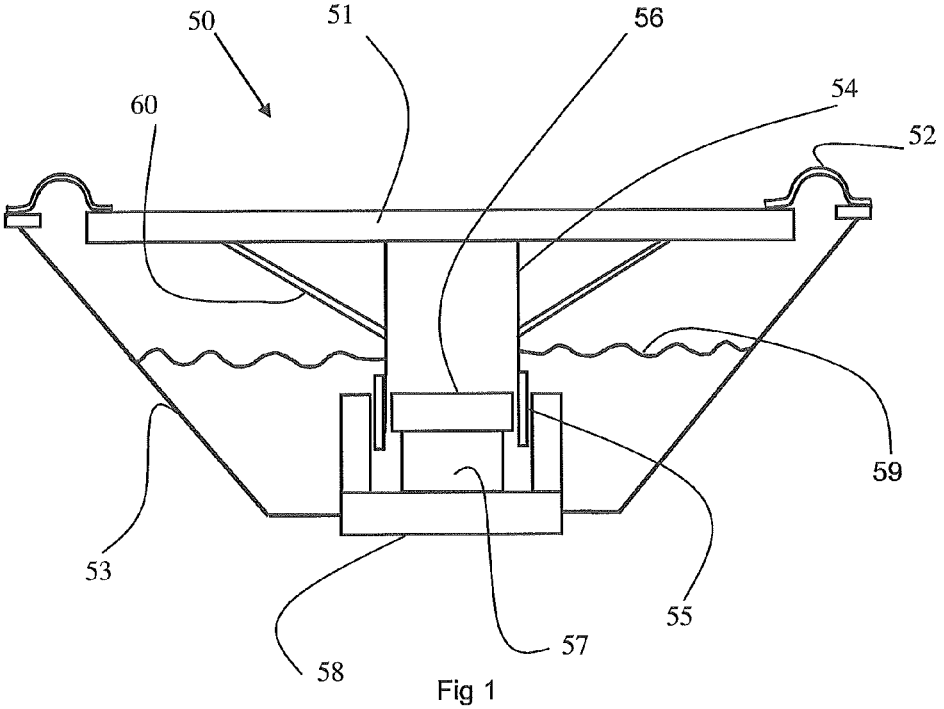
FIG. 1 is a cross section of a circular speaker driver.

In FIG. 1, there is shown an acoustic device in the form of a loudspeaker drive unit 50 intended to operate pistonically and in bending having a circular flat panel-form radiator 51 supported at its periphery by a flexible circular suspension 52 attached to a circular chassis 53. A cylindrical bobbin or coil former 54 is concentrically attached to the rear side of the panel 51, e.g. by means of an adhesive, and the end of the bobbin remote from the panel carries a voice coil 55 positioned in the air gap between the front plate 56 of a magnet 57 in a cup 58. Connected to the circumference of the bobbin 54 between the voice coil 55 and the panel 51 is a circular suspension or spider 59 which supports the bobbin in the chassis 53 for axial movement in the air gap.

Also connected to the bobbin 54 at a position between the spider and the panel 51 is a conical coupler 60 whose outer rim is connected to the panel 51 at or near to the first nodal line of the panel; this nodal line is a circle at approximately ⅔ of the panel diameter.

In operation, the voice coil 55 causes the bobbin 54 to vibrate and the bobbin drives the panel-form radiator 51 pistonically at lower frequencies and in bending mode region at higher frequencies, the suspension 52 and spider 59 permitting such movement while providing axial restoring forces and centring forces when the panel is displaced. The connection of the conical coupler 60 at the first nodal line suppresses the lowest natural frequency of the panel 51 while the bobbin drives the panel directly at other, higher frequencies.

Figure 2:
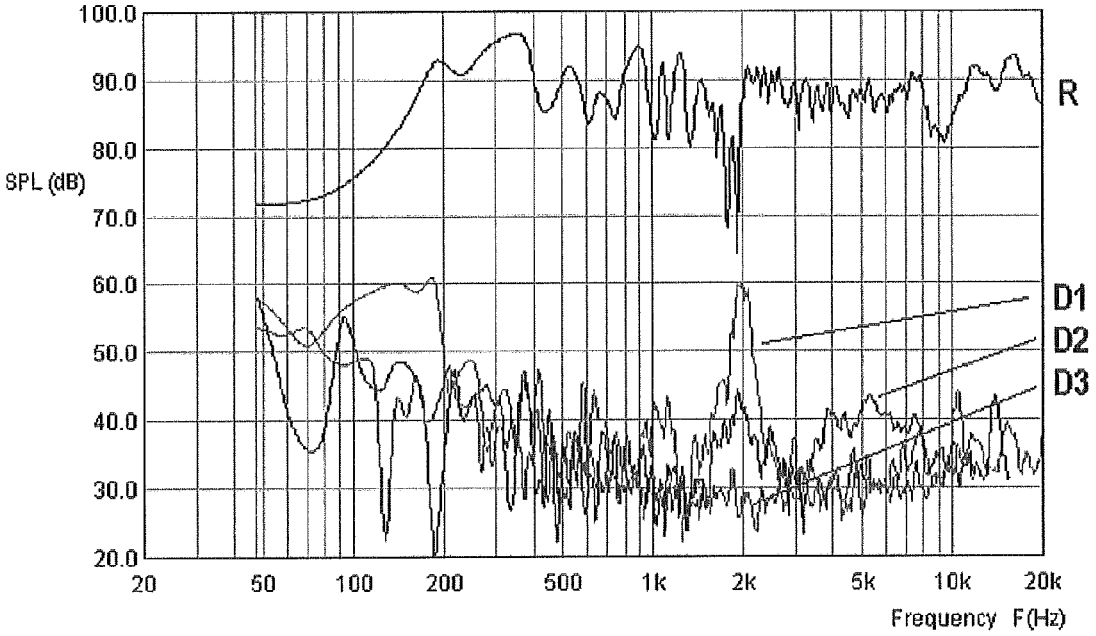
FIG. 2 is an on-axis frequency response typical of prior art speakers.

Referring now to FIG. 2, this shows the characteristics of a typical prior art flat panel loudspeaker. In a plot of sound pressure level SPL in decibels against frequency F in Hertz, the on-axis frequency response R has a clear dip at about 2 kHz while the distortion curves at the second, third and fourth harmonics, D1, D2, D3 respectively, all show clear peaks at this frequency.

Figure 3:
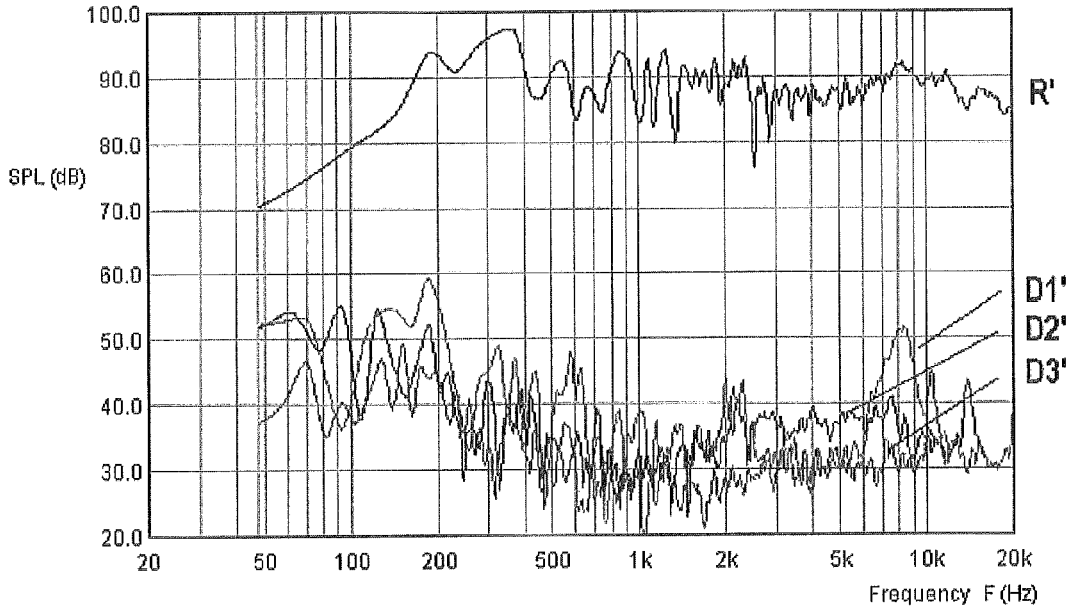
FIG. 3 is an on-axis frequency response of a speaker according to the invention.

FIG. 3 shows the characteristics of a loudspeaker similar to that of FIG. 2 but made according to the present invention. The on-axis frequency response R' does not show a dip at 2 kHz, and the distortion characteristics at the harmonics D1', D2', D3' are improved.

The conical coupler 60 preferably needs only to couple to the panel 51 in the frequency region at which there would otherwise be adverse response anomalies as shown in FIG. 2. The coupler 60 can be designed, using well-known acoustic techniques, by choice of material and of profile, e.g. using metal foil, paper or polymer shells and profiles such as conical and flared. The coupler is intended to suppress the lowest natural frequency of the panel radiator 51 but preferably should decouple from the panel at higher frequencies, from just above the lowest natural frequency of the panel to below the frequency which generates the second mode. For a free circular disc these two frequencies are in the ratio 1:4.2. The use of the coupler 60 in the inventive manner also allows the diameter of the voice coil 55 to be of conventional size relative to the diameter of the panel 51.

The panel-form radiator 51 may be a composite comprising upper and lower skins bonded to a lightweight core, or from a honeycomb core made of aluminium, paper, "Nomex"™, expanded polymers, balsa and the like, with skins made of paper, aluminium foil, glass fibre, carbon fibre, Nomex, polymer film, crystal polymer and the like. Alternatively the radiator 51 may be monolithic and of any of the skin materials mentioned above. All such materials are conventionally used in loudspeaker construction. The loudspeaker designer selects a material to give a first resonant mode of the panel at a chosen frequency. The coupler 60 can be made of the same range of materials as the panel 51, or of materials normally used for traditional loudspeaker manufacture, and can have a shape which in section is straight, convex or concave or complex.

FIGS. 4 to 9 are enlarged detail sections showing variations to the construction of FIG. 1 and identical integers are numbered accordingly.

Figure 4:
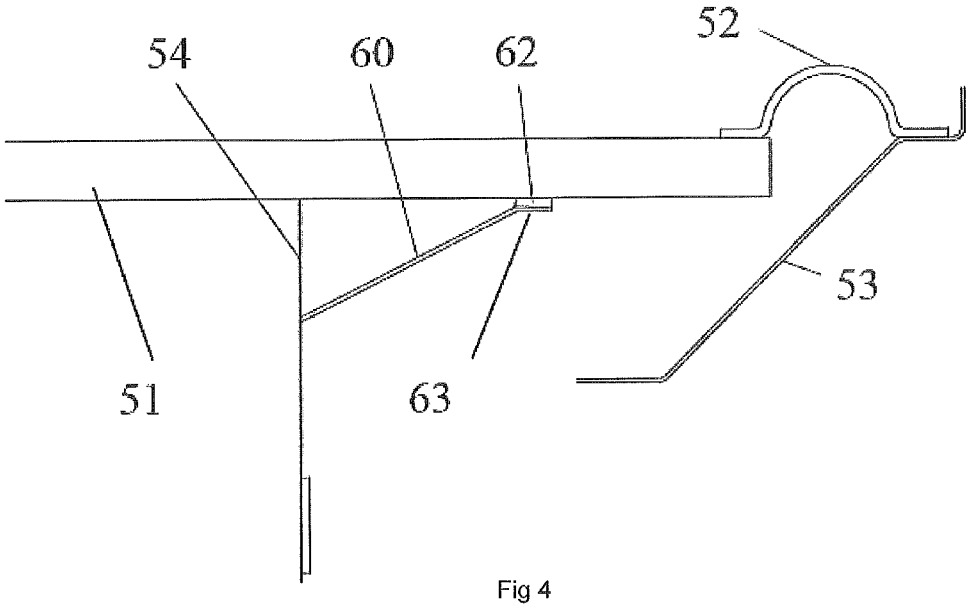
FIGS. 4 to 9 illustrate minor variations of the FIG. 1 embodiment.

In FIG. 4 the coupler 60 is connected to the panel 51 by an annular compliant annular member 62 of rectangular cross section, carried by an outwardly extending flange 63 of the coupler 60. The compliant member may be made of rubber, foamed plastic, or other similar material of such a stiffness that force from the bobbin 54 via the coupler 60 is transmitted to the panel 51 at lower frequencies but not at frequencies in the range between the first and second natural bending frequencies of the radiator. Thus the coupler 60 is decoupled at higher frequencies by the compliant member 62. The panel is also driven directly by the bobbin 54 at a smaller diameter than the coupler.

Figure 5:
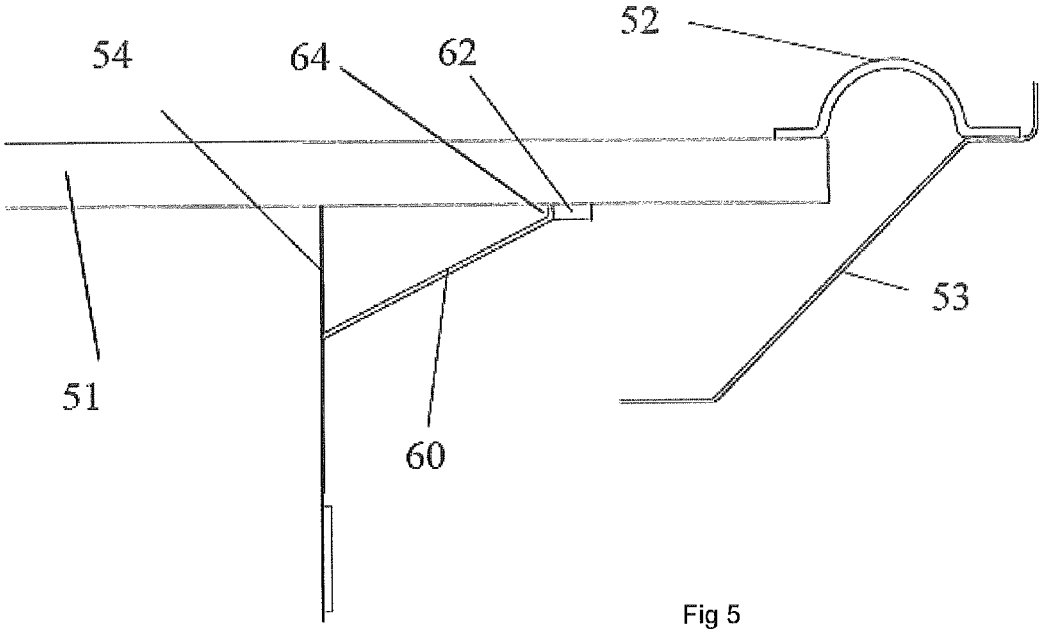

FIG. 5 shows an alternative to the FIG. 4 arrangement in which the outer edge of the coupler 60 has small lip 64 perpendicular to the panel 51, the compliant member 62 being attached to the lip 64 and the panel 51. This arrangement permits a shearing action whereby compliant materials may perform more consistently.

Figure 6:
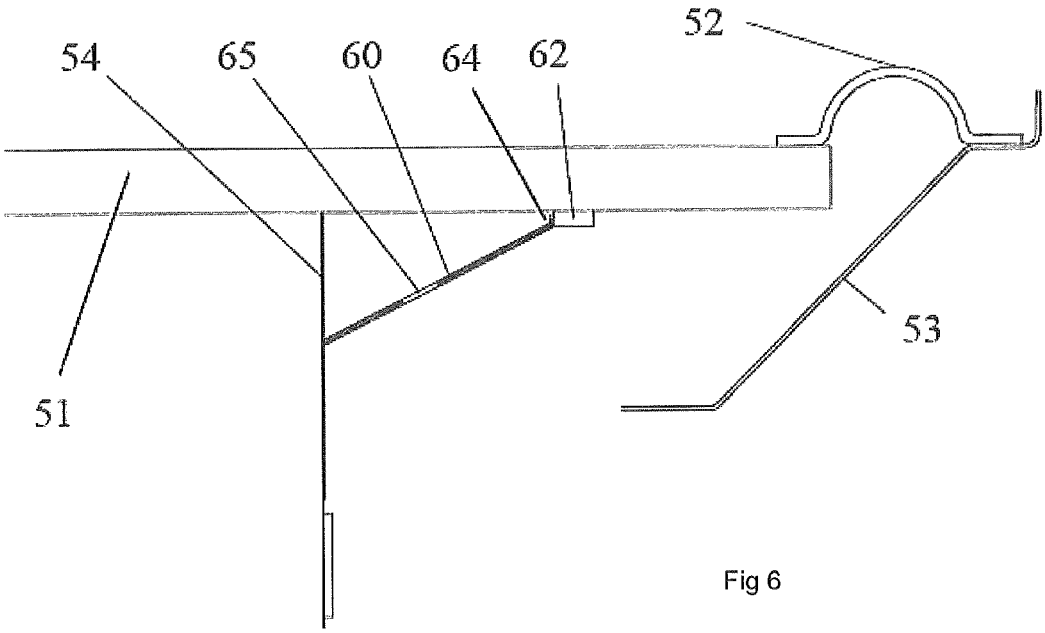

In FIG. 6 the coupler 60 is formed with perforations 65 which allow the unrestricted movement of air to avoid unwanted air spring stiffness of the coupler which may cause unwanted "chuffing" sounds. The perforations may be used to reduce the mass of the coupler. The bobbin 54 may similarly be perforated (not shown) at positions above and/or below the junction with the coupler 60 to avoid unwanted blowing sounds. In both examples the perforations may be in the form of a mesh having an open area of, for example, 50% to 60%. For both the coupler and the bobbin, the presence of perforations, meshed or not, has the advantage of reducing the overall moving mass of the loudspeaker radiator and therefore increasing its sensitivity.

Figure 7:
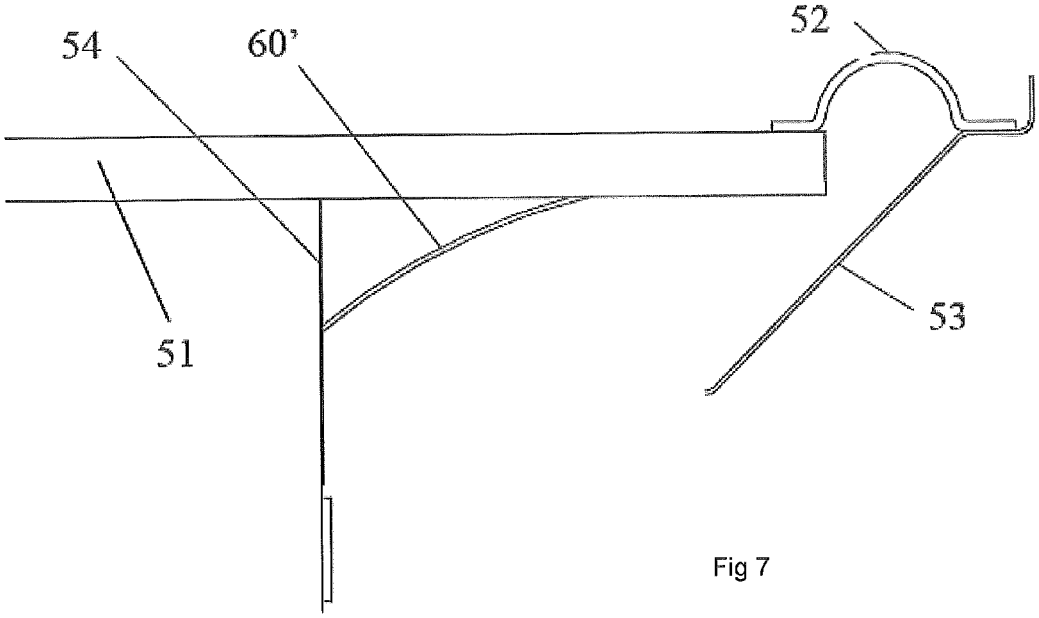
Figure 8:
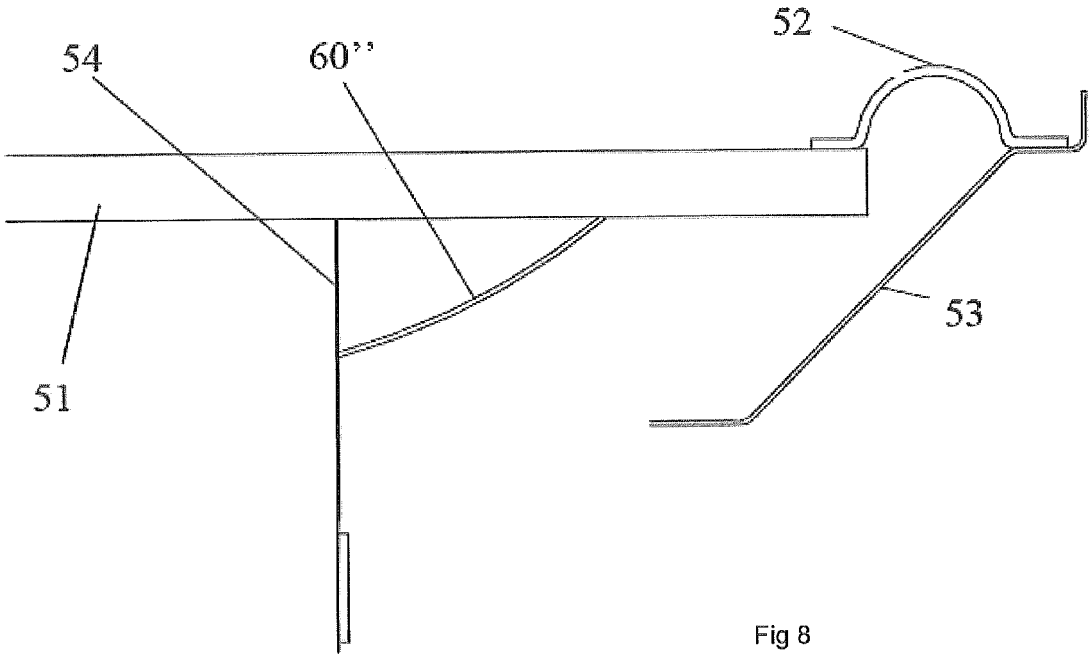

FIG. 7 shows a coupler 60' which has a convex curvature towards the rear side of the panel 51, and FIG. 8 shows a coupler 60" which has a concave curvature towards the rear side of the panel. In these variations the curvature may be selected so that the coupler self-decouples from the panel at the desired frequency.

Figure 9:
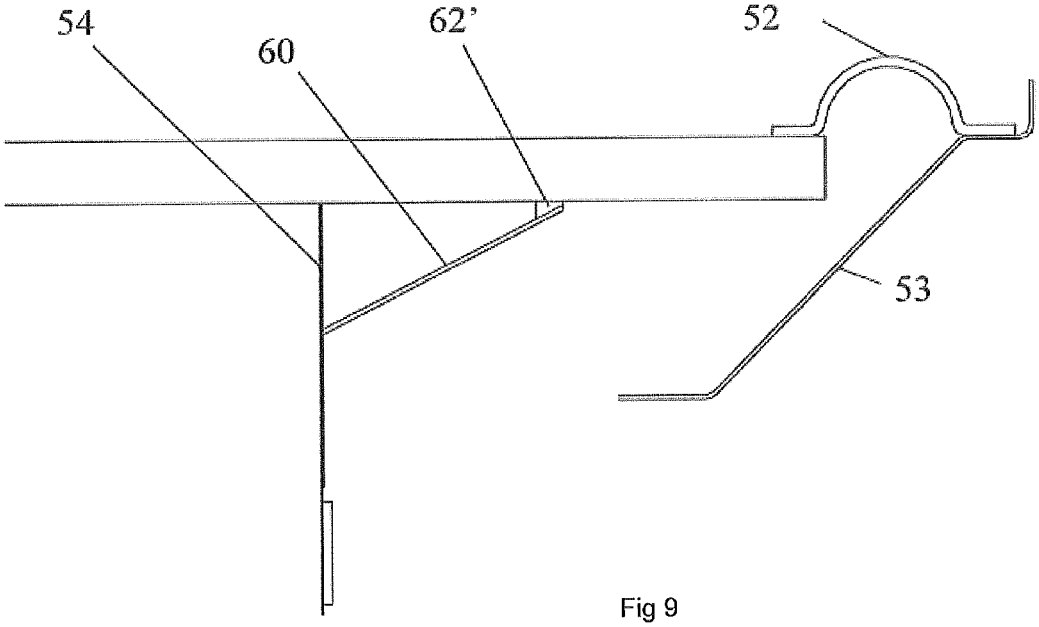

FIG. 9 shows an annular compliant member 62' of triangular section located within the outer rim of the coupler 60. Again the material is selected so that it is relatively stiff at low frequency but decouples above a selected frequency.

In any variation of the first embodiment, the coupler need not be continuous, but can be segmental or slotted or formed in strips. This reduces the overall moving mass and improves sensitivity. The connection to the panel is preferably over a full circle, so that the coupler is a single piece overall.

Figure 10:
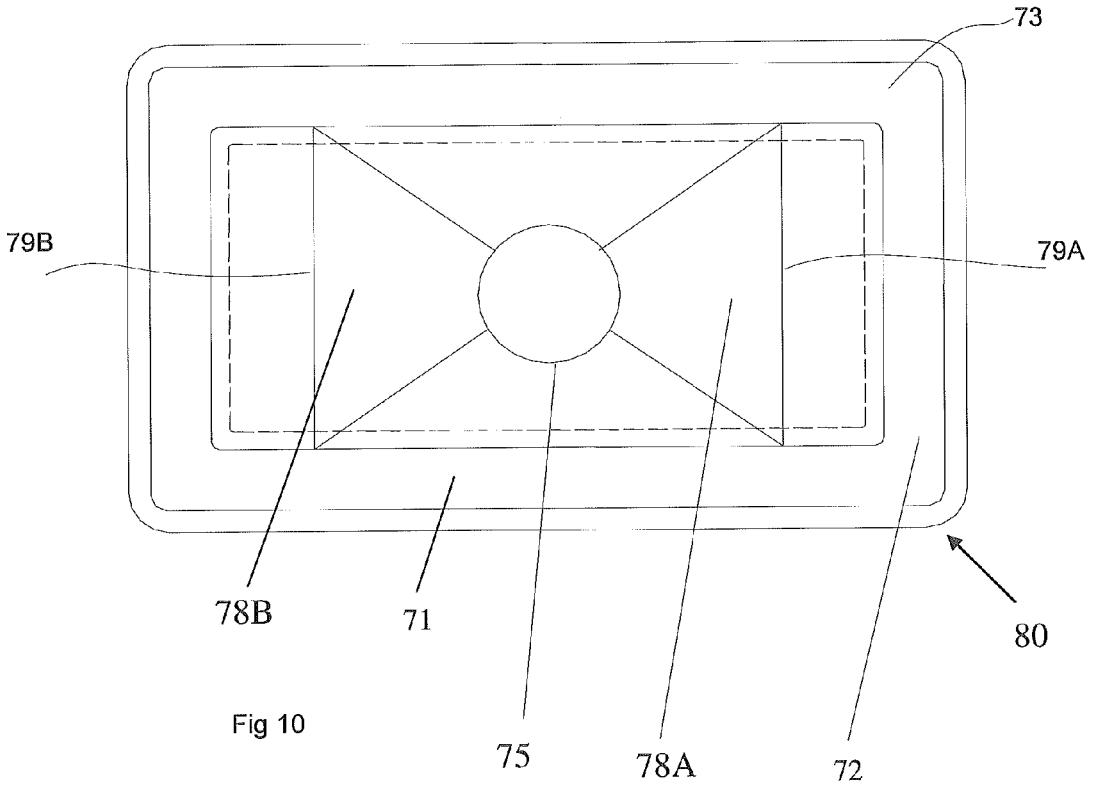
FIG. 10 is a front view of an embodiment of rectangular radiator speaker driver.
Figure 11:
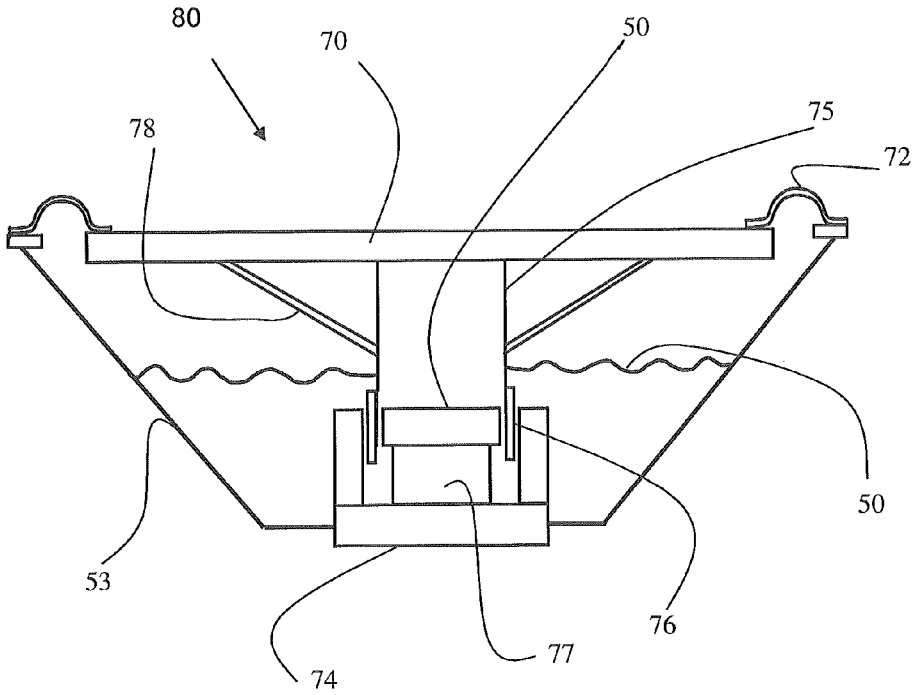
FIG. 11 is a cross sectional view of the driver of FIG. 10.

A second embodiment of acoustic device in the form of a loudspeaker drive unit 80 intended to operate pistonically and in bending is shown in FIGS. 10 and 11 in which the panel 70 is rectangular. Around its edges is a rectangular compliant suspension with long and short straight sections 71, 72 connected by radiused corners 73. The coil 76 and cylindrical bobbin 75 are visible. The bobbin 75 carries the voice coil 76 in the air gap of the magnet 77 in the cup 74.

The coupler 78 is in two parts 78A, 78B, arranged symmetrically, and forming a "bow tie" shape. Parts 78A and 78B are connected to the cylindrical bobbin 75 along curved edges but connect to the radiator panel 70 along the first nodal lines, which in a rectangular panel are straight lines on either side of the position at which the radiator is driven. The connections are at 79A, 79B. In a minor variation the coupler 78 may extend around the full circumference of the bobbin 75.

In other embodiments of acoustic devices formed as loudspeaker drive units intended to operate pistonically and in bending, not illustrated, the material of the panel-form radiator may be anisotropic in bending stiffness, in which case the first nodal line would be elliptical and an elliptical coupler would be required at the junction with the radiator.

For a rectangular radiator panel, especially one of high aspect ratio, two or more spaced bobbins could be provided, each with a coupler mounted to the radiator at or near to the first nodal line of the radiator.

Figure 12:
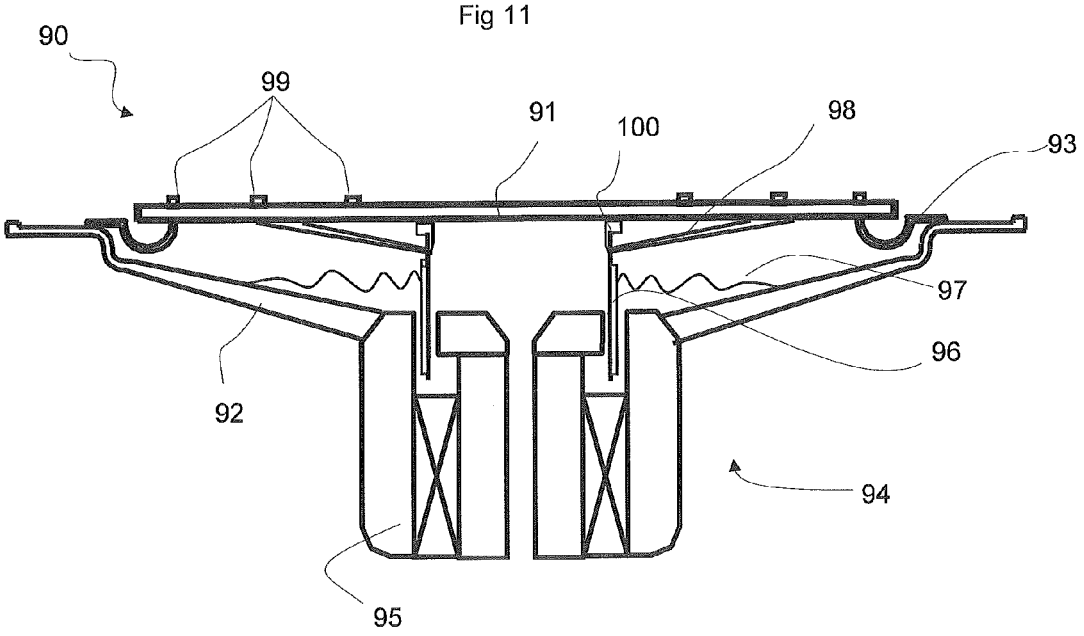
FIG. 12 is a cross sectional side view of a further embodiment of loudspeaker driver.

In FIG. 12 there is shown an acoustic device 90 in the form of a loudspeaker driver that is generally similar to that of FIG. 1 above and comprising a circular planar acoustic radiator or diaphragm 91 suspended in a chassis 92 by means of a compliant suspension surround 93 coupled between the peripheral edge of the radiator and the chassis. A moving coil motor 94 is mounted with its magnet system 95 on the chassis and with a voice coil assembly 96, comprising a voice coil and tubular former or bobbin, suspended for axial movement in an annular gap in the magnet assembly. The voice coil of the voice coil assembly is disposed near to one end of the bobbin in the annular gap and the other end of the voice coil assembly is fixed to the radiator, e.g. by means of an adhesive, via an annular foot 100 formed from a plastics material, which foot is rigidly fixed to the end of the bobbin. A suspension spider 97 is coupled between the voice coil former and the chassis to guide the voice coil assembly in its axial movement and to prevent sideways movement thereof. A generally frusto-conical coupling member 98 is mounted at its smaller end to the coil former and at larger end to the underside of the radiator at or near to the first bending mode of the radiator. It will be noticed that the wall thickness of the coupler member tapers inwardly towards its smaller diameter.

In the embodiment of FIG. 12, three concentric annular masses 99 are positioned on the radiator, in the manner described in WO 2005/101899 of New Transducers Limited, whereby the acoustic device becomes a balanced mode radiator.

The coupling member used in the driver of FIG. 12 improves the on-axis dip and distortion products for a BMR driver, but when a stiff, anisotropic panel is used, the mode shape of the first panel mode can be slightly distorted. This means that the on-axis volume velocity from this mode is not exactly zero. Decreasing the panel stiffness can improve the on-axis dip, by reducing the anisotropy, but this will lead to lower mode frequencies, which may not be desirable.

BMR teaching gives a value of added mass for a BMR, so that the balancing would be ideal for an isotropic panel, but where the panel is anisotropic, the core and skins create a preferred direction of stiffness. This can vary with the core thickness, since the core often dominates the overall panel stiffness. This anisotropy is well-known for those familiar with panel loudspeakers. In this case, there may still be a residual on-axis dip caused by the imbalance of the volume velocity at the first mode.

Figure 13:
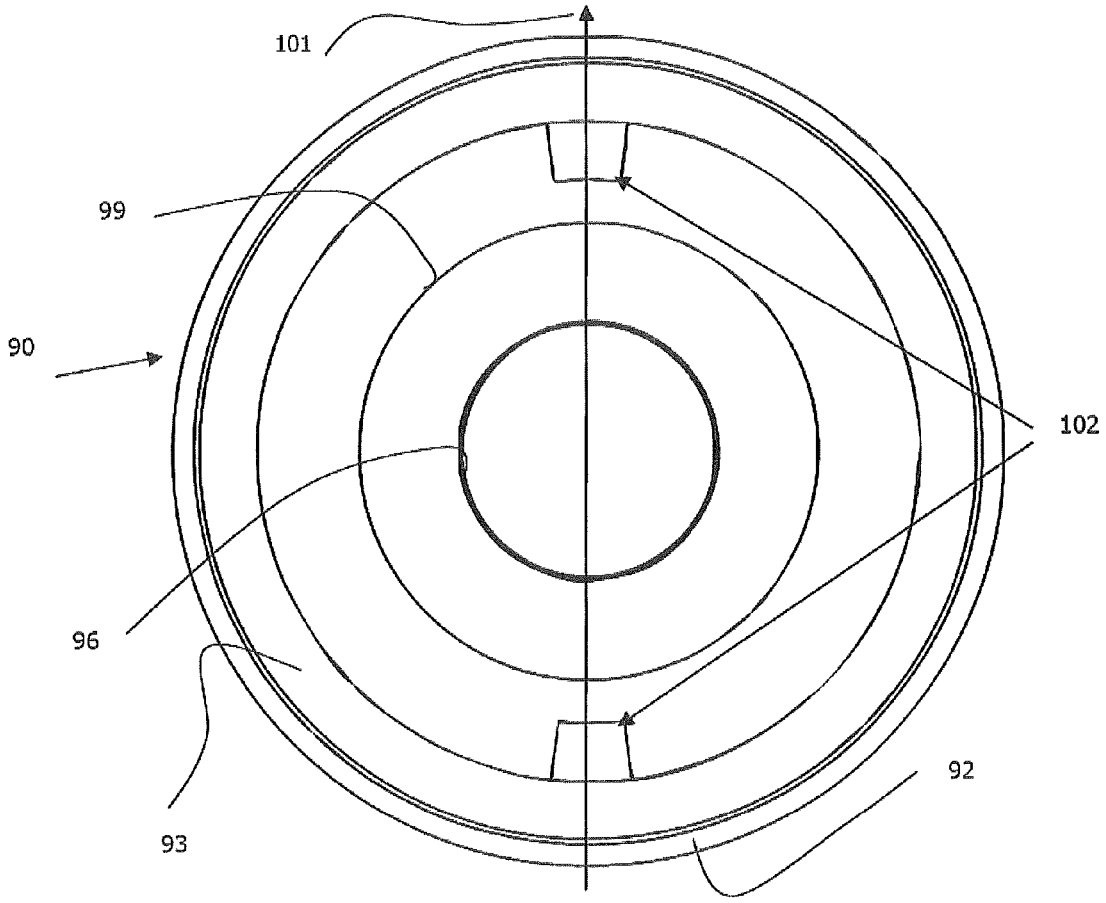
FIG. 13 is a plan view of a modified form of the loudspeaker driver of FIG. 12.

To overcome this, the same balancing mass, that is a mass 102 equivalent to the overall mass of the annular ring mass taught by BMR, can be concentrated at two diametrically opposed positions, substantially on the stiffer axis 101 of the panel, as shown in FIG. 13. This reduces the imbalance in the volume velocity and restores the on-axis response by eliminating the response dip. The positions of the centre of mass for these two added masses are substantially the same radial position as prescribed for the added mass ring in the isotropic panel BMR design. Some final adjustment may be needed during development, as well as adding moulded features to locate the masses with respect to the panel. The masses can be typically made from moulded rubber, plastic, or even made from metal, or combinations of metal and polymers to suit each design.

The stiffer axis can be deduced from the panel construction and is usually the axis of the honeycomb core for thicker panels. A laser may be used to check the panel mode shape.

The loudspeaker drivers described and shown in the various embodiments set-out above can be used in full-range loudspeakers having a frequency range extending over at least seven octaves.

The invention claimed is:

1. An acoustic device operable pistonically and in bending, comprising:

a panel-form acoustic radiator having a perimeter and a lowest natural frequency with an associated first nodal line of bending resonance;

a magnetic drive system including a voice coil on a tubular bobbin, the bobbin being directly coupled to the radiator to drive the radiator directly; and a coupling device connected to the bobbin and to the radiator at a position between the bobbin connection to the radiator and its perimeter and at or near to said first nodal line of bending resonance, the acoustic device is arranged with the bobbin to drive the radiator directly and the coupling device to suppress the lowest natural frequency of the radiator.

2. An acoustic device according to claim 1, in which the radiator is circular and the coupling device is a cone connected to the radiator at a circle at approximately ⅔ of the panel diameter.

3. An acoustic device according to claim 2, in which the sides of the conical coupler are convex or concave.

4. An acoustic device according to claim 1, in which the radiator is rectangular and the coupling device is connected to the radiator along at least one straight line at or near to the first nodal line of the radiator.

5. An acoustic device according to claim 1, in which the coupling device is arranged to decouple from the radiator at a frequency slightly above the frequency of said first nodal line.

6. An acoustic device according to claim 1, in which the coupling device is arranged to decouple from the radiator at a frequency slightly above the frequency which generates the first nodal line.

7. An acoustic device according to claim 6, in which the coupling device is connected to the radiator through a compliant member which provides said decoupling.

8. An acoustic device according to claim 1, wherein the radiator has an area and an operating frequency range, and the radiator being adapted such that it has resonant modes in the operating frequency range, and at least one mechanical impedance means coupled to or integral with the radiator, the positioning and mass of the at least one mechanical impedance means being such that the net transverse modal velocity over the area of the radiator tends to zero.

9. An acoustic device according to claim 8, wherein the radiator is anisotropic in bending stiffness and has a symmetrically disposed axis of greater bending stiffness, and wherein the mass of at least one mechanical impedance means is positioned at two opposed locations substantially on the said axis of greater stiffness.

10. An acoustic device according to claim 9, wherein the two masses are disposed at or near to the edge of the radiator.

11. An acoustic device according to claim 1, wherein the acoustic device is a full-range device having a frequency range of at least seven octaves.

12. A loudspeaker comprising an acoustic device as claimed in claim 1.

13. A loudspeaker drive unit comprising an acoustic device as claimed in claim 1.

14. A method of improving the on-axis response of a loudspeaker having a panel-form radiator having a perimeter and a lowest natural frequency with an associated first nodal line of bending resonance and operable both pistonically and in bending, comprising driving the radiator by a directly connected tubular bobbin, and suppressing the lowest natural frequency of the radiator by providing a coupler connected from the bobbin to the radiator between the bobbin connection to the radiator and its perimeter and at or near to said first nodal line of bending resonance.

15. An acoustic device according to claim 1 wherein the coupling device has a thickness that tapers inwardly towards the bobbin.

* * * * *